United States Patent [19]

Soules et al.

[11] Patent Number: 5,067,713

[45] Date of Patent: Nov. 26, 1991

[54] CODED PLAYING CARDS AND APPARATUS FOR DEALING A SET OF CARDS

[75] Inventors: Jack A. Soules, Shaker Heights; Bryan D. Carpenter, Cleveland, both of Ohio

[73] Assignee: Technical Systems Corp., Cleveland, Ohio

[21] Appl. No.: 501,148

[22] Filed: Mar. 29, 1990

[51] Int. Cl.[5] ..... A63F 1/14

[52] U.S. Cl. ..... 273/149 P

[58] Field of Search ..... 273/149 P, 292, 296, 273/304, DIG. 24; 283/901, 75, 87, 88, 89; 434/331

[56] References Cited

U.S. PATENT DOCUMENTS

| | | | |
|---|---|---|---|
| 3,640,009 | 2/1972 | Komiyama | 283/88 |
| 4,534,562 | 8/1985 | Cuff et al. | 273/149 P |
| 4,662,637 | 5/1987 | Pfeiffer | 273/149 P |
| 4,889,367 | 12/1989 | Miller | 283/88 |

*Primary Examiner*—William H. Grieb

*Attorney, Agent, or Firm*—Alfred D. Lobo

[57] ABSTRACT

A deck of cards is coded by marking each card on its face with a bar code which is essentially invisible to the human eye, but can be read by a detector matched to the source of wavelength of the light used to irradiate each card as it is passed over the surface of a portable housing which houses the detector and the associated reading means. Appropriate hardware is also housed in the housing to process the coded information read. The software provided stores a number of predetermined "hands" which are to be dealt. It can also deal a random deal, more random than can be dealt by human shuffling of the deck. A method is provided to deal a preselected "deal" to a chosen number of players, typically four, the apparatus indicating to the human dealer to which location each card is to be dealt.

9 Claims, 6 Drawing Sheets

CODED PLAYING CARDS AND APPARATUS FOR DEALING A SET OF CARDS

BACKGROUND OF THE INVENTION

This invention relates to a playing card coded on its identifying face in a manner such that an electronic device can identify the card and indicate to a person dealing the cards where each card is to be dealt. As one skilled in the art will readily appreciate, coding a deck of playing cards, each with a code, for example a "bar code", by which each card is uniquely identified, is a routine task. However, using a device to deal a deck of cards so that a preselected "hand" stored in the memory of the device, is dealt to each player, and to do so in an error-free, repetitive manner, is not a simple problem. Numerous playing card distributing devices have been proposed in the prior art, but each is prey to at least one technical problem, and none is economical enough to be used by the general public.

For example, a common characteristic of coded playing cards coded as suggested in the prior art, is that the bar code is marked so that it can be seen by the human eye and read by light in the range of visible wavelength. To read such bar codes it was necessary not to overprint the face markings of the playing cards. Therefore the cards were marked on the side edges. Our invention uses an essentially invisible bar code which can be read by an electro-optical reading means which uses light in the infrared or ultra-violet region, as described in greater detail hereinbelow. Thus, for the first time, we have now been able to provide a playing card which can be marked all over its surface, if so desired, without visibly defacing the card. The unexpected result of being able to code a card essentially invisibly is that the card may be over-printed with the code repetitively, thus enabling the card to be read in any generally lateral orientation whatsoever.

The matter of economics is of particular importance because the game of Contract Bridge is played by a large segment of the population of the world, and it is essential that a device, such as the one of our invention, be affordable if a player is to practice playing preselected hands, wishes to teach himself how to play the game more astutely, or participate in the game of Duplicate Bridge.

Duplicate Bridge is played in essentially the same manner all over the world as a test of skill in a game in which the same deal is played more than once at different tables. Thus it becomes important that many decks of cards be dealt in preselected sets of 13 cards each to each set of competitors.

It will now be evident that the apparatus and coding system of this invention can also be used to deal hands in the game of poker, or any other card game in which specific cards are to be dealt to a specified location according to directions provided by the memory of the device.

The device is particularly useful as a teaching device because a "chip" can be provided with "teaching hands", and the level of the game being taught can be tailored to the expertise of the learner by simply replacing one chip with another.

Further details for playing the game of Duplicate Bridge, or any other card game where a deck of cards is to be dealt in a prescribed manner, are not of particular importance here. The thrust of this invention is that it provides a device for manually dealing a deck of cards, or any portion thereof, in a preselected manner, by simply sliding each card, face down, across a surface in which electro-optical reading means to identify the card, and means to match the identification of the card with an instruction in the device's memory, result in a signal being given to the dealer as to where (which location) that card is to be dealt.

The foregoing purposes of an apparatus for dealing coded playing cards each coded according to a "bar code" coding system, are fulfilled by a device disclosed in U.S. Pat. No. 4,534,562 to Cuff et al. (class 273/subclass 149P). However, the device has the drawback of requiring an opening in the housing for introducing a playing card into the apparatus, and a guide means to guide the card past the electro-optical reading means. The sides of an opening in the housing, or those of a guide means, if either is provided, touch and scuff the sides of cards as they are passed through, thus damaging them. Neither an opening in the housing, nor a guide means is therefore desirable, but neither can be avoided in devices of the prior art if the card is to be identified by the electro-optical reading means.

Our device uses neither an opening in the housing, nor a guide means.

SUMMARY OF THE INVENTION

It has been discovered that each playing card in a deck of playing cards may be identified with machine-readable indicia essentially invisible to the human eye which of course, reads the printed identification of the card which designates its "suit" (whether, spades, hearts, diamonds or clubs) and its designation in the suit (Ace, King, Queen, etc.). Each card in the deck is then manually slid across a surface, the orientation of the card being of no consequence so long as the code is imprinted along each margin of the card, or is imprinted over the entire surface of the card. If the code is imprinted directionally, that is, either in the direction of the longitudinal or horizontal axis, then the card will be read as long as a portion of the card carrying the imprinted code passes transversely (that is, not parallel to the direction in which lines of the indicia are marked on the card) over an electro-optical reading means which identifies the card. The code read is then compared to a predetermined list of locations to determine which player position (North, South, East, West) the card is to be dealt. A signal is then generated to indicate to which position the identified card is to be dealt, and the dealer deals the card to the indicated position. The signal may be visual, for example a light, or it may be an audio signal or a speech processor within the device stating "North" , "South", etc. identifying the location.

It is therefore a general object of this invention to provide an apparatus to allow a dealer to deal coded playing cards to each of plural locations so that a preselected set of cards is dealt to each specific location, the apparatus comprising, a housing having a planar surface over which a plurality of coded cards are passed over (slid), one card at a time; reading means for electro-optically reading each said one card as it is moved past the reading means; means for storing a number of predetermined lists or "hands" or sets which are to be dealt as chosen; and, code-processing means for processing the code read from each card in a predetermined manner to execute a program which identifies each location to which each card is to be dealt.

It is a specific object of this invention to provide a label or other laminar article marked with conventional visible indicia but overprinted with a bar code in the form of either a textured surface, or invisible ink.

It is a specific object of this invention to provide a playing card with a surface identified with indicia which are essentially invisible to the human naked eye but which can be read by an electro-optical reading means sensitive to light outside the wavelength in the visible range, that is, light with wavelength shorter than about 4000 Angstroms or longer than about 7000 Angstroms (or 400 to 700 nanometers "nm").

It is another specific object of this invention to provide a playing card which is coded across its entire face, or along each of the four margins thereof, with indicia which are essentially invisible to the naked eye but which can be read by an electro-optical reading means sensitive to light in the wavelength range above about 7000 Angstroms (700 nm) but below about $2.2\times10^5$ A, preferably in the infra-red range from about 800 nm to about 2000 nm. Coding with indicia imprinted or otherwise marked across the entire surface or along each margin, any portion of the surface or margin completely identifying each card, allows any portion of the card to be passed over the electro-optical reading means and be read.

It is another specific object of this invention to provide a compact, portable, battery-driven pocket-book size housing the surface of which is not substantially larger in area than a standard playing card, within which housing is mounted an infrared detector directed upwardly and through a portion of the surface, which portion is permeable to the wavelength to which the infrared detector is sensitive, so that it is difficult to slide a card over the deck without a readable code portion of the card passing over the detector.

It is another specific object of this invention to provide a stand-alone microprocessor-controlled intelligent card-dealing device to assist a human dealer to sort cards into predetermined hands without knowing the identification of any of the cards in any hand. The convenience and economy of the device is highlighted by the ability to provide plural such devices at plural locations, at each of which the same hand can be dealt as quickly as the cards can be manually passed over the deck.

It is still another specific object of this invention to provide a card-reading device which permits the dealer to verify the location to which a card is designated, at any time during or after the deal.

It is also a specific object of this invention to provide a solid-state card-reading device with no moving parts, hence essentially free of risk of failure due to mechanical malfunctions.

It is yet another specific object of this invention to provide means for calling up a deal of choice by setting a numerical identification for stored information corresponding to that deal.

It is a further specific object of this invention to provide a card-reading device which is put into operation by simply actuating any switch for identifying a hand to be dealt; if a card is not read or a new hand not selected within a predetermined period of time, the device automatically shuts itself off.

DETAILED DESCRIPTION OF PREFERRED EMBODIMENTS

Figure 1:
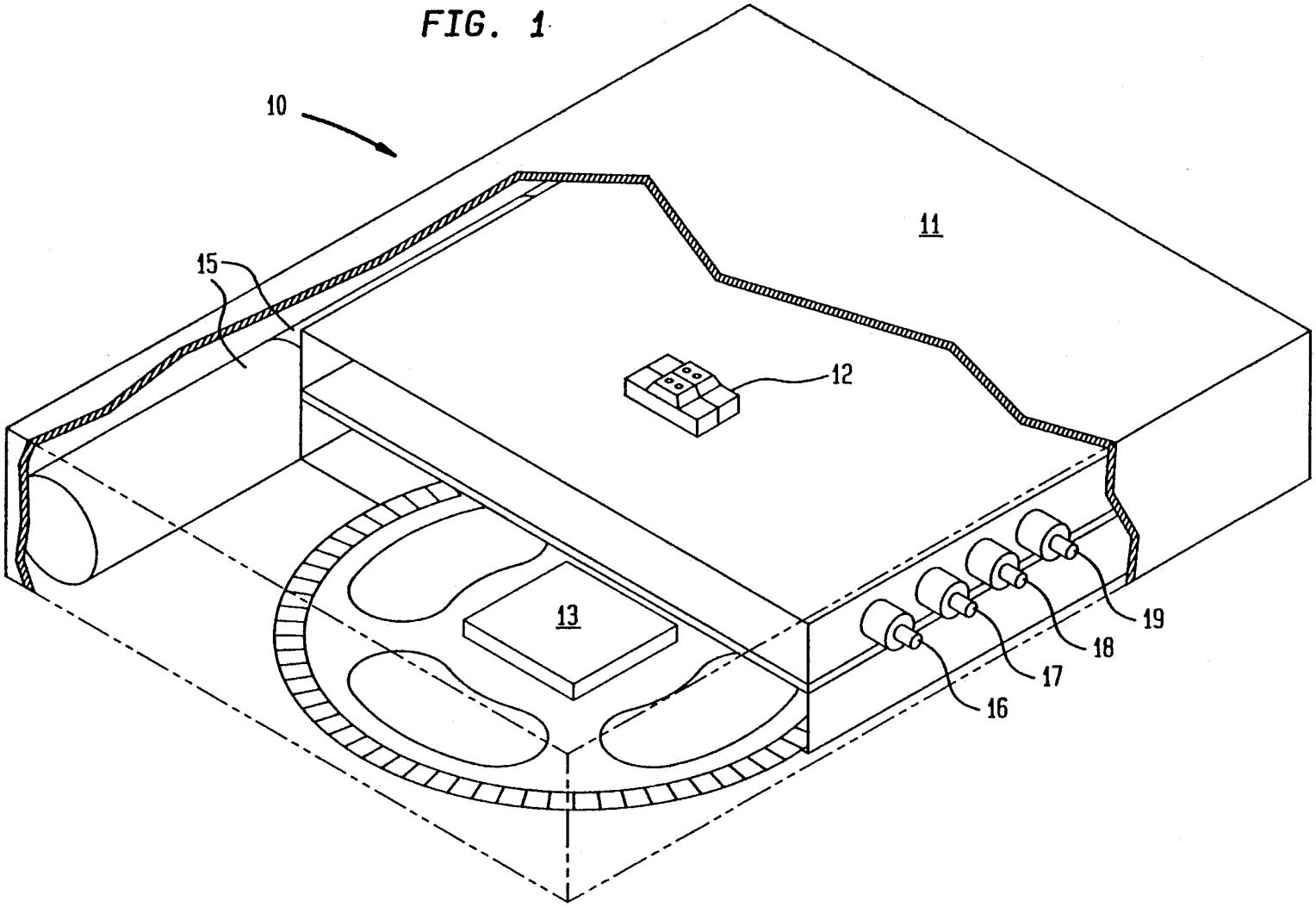
FIG. 1 is a perspective view, with a portion broken away, schematically illustrating the card-reading device of this invention with portions sectioned through the platform which provides the surface over which individual cards are slid.

Referring to the drawing, there is shown in FIG. 1 a perspective view of a preferred embodiment of our card-reader indicated generally by reference numeral 10 which comprises a housing which is a generally rectangular parallelopiped having a planar surface 11 at least a portion of which is permeable (that is, transparent) to the wavelength to be used to read a playing card passed laterally over the surface, preferably in surface-to-surface contact therewith. In the embodiment illustrated the housing is approximately 18 cm long and 12 cm wide with a depth of about 4 cm. It will be readily apparent to one skilled in the art that the overall size of the housing may be shrunk substantially so that the area of the deck is comparable to that of a standard playing card, such shrinkage entailing "surface-mount" technology and an appropriately compact power source. The degree to which such shrinkage is justified will be dictated by the ultimate cost of the device. Within the housing 11 is mounted an electro-optical reading means 12 having an "eye" aimed directly upwards through that portion of the platform which is permeable. The platform is preferably flat, but may be shaped to conform to cards of arbitrary curvature, or which are bent or curved in being passed in contact with the platform's surface.

In the best embodiment the device uses an infrared source and matching detector and responds to the differences in reflectivity and absorptivity of the prepared, coded surface of each card. In an analogous embodiment an ultraviolet source and matching detector is used. In the ultraviolet case, the coded surface may vary in either reflectivity or absorptivity, or in fluorescence. In the latter case, the detector would be chosen to respond to visible fluorescence excited by the ultraviolet. Thus it is seen that the detector may be chosen to respond to actinic radiation whether such radiation is below 4000Å or above 7000Å provided that the either the actinic radiation or the fluorescense generated is essentially invisible to the human eye.

More specifically, Table I lists the various combinations of sources, appropriate detectors and the optical response which is monitored.

TABLE I

| Source | Detector | Optical response |
|---|---|---|
| IR | IR | Differential reflectivity or long wavelength fluorescence |
| Visible | IR | fluorescence |
| UV | Visible | fluorescence |
| UV | UV | reflectivity |

The reading means 12 is mounted on a control board 13 on the underside of which is also mounted a microprocessor (see FIG. 2) 14 and other solid-state components. Battery means 15 provide a convenient power source in the form of several sub-C cells each having a normal voltage of 1.25 volts. Keys 16, 17, 18 and 19 are operatively connected to the solid-state devices on the control board to provide the functions described hereinafter in the flow charts.

Figure 2:
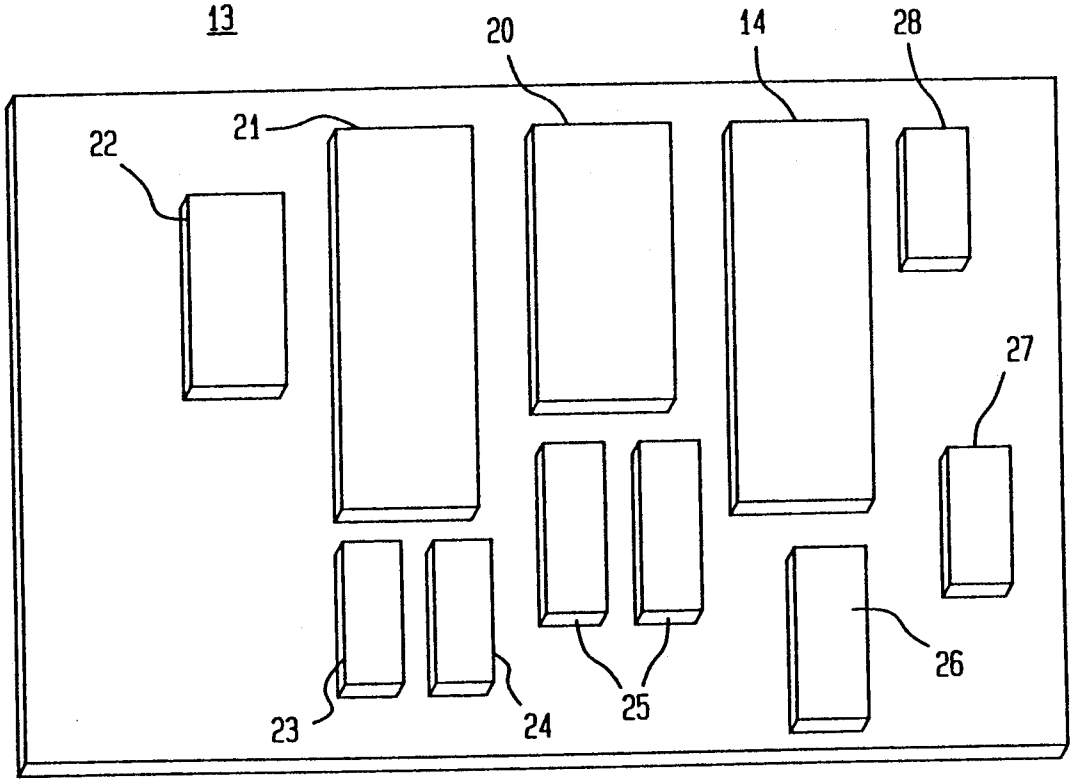
FIG. 2 is a plan view graphically illustrating the control board including essential components which are operatively inter-connected to perform the functions of the apparatus.

Referring now to FIG. 2 which is a bottom plan view of the control board 13, there is shown the solid-state elements which interact to provide the above-described functions. These include a microprocessor 14 which is a Z80-A; an erasable programmable memory 20; a peripheral interface adapter 21 which interfaces the reading means 12, an indicating means 22 which may be a speech processor or indicating lights positioned at each location to which the cards are to be dealt, and the keys 16–19. A first multiple Schmidt trigger 23 and a serial shift register 24 converts raw light pulses to a digital word. A read-write random access memory 25 is used to store preset operating conditions, for example, a specifically chosen deal. A low current, reed-type relay 26 controls power-on and power-off. An address decode 27 determines the architecture of the memory. A second multiple Schmidt trigger 28 together with a resistance-capacitor network determines the operating clock frequency of the MPU (microprocessor unit).

Figure 6:
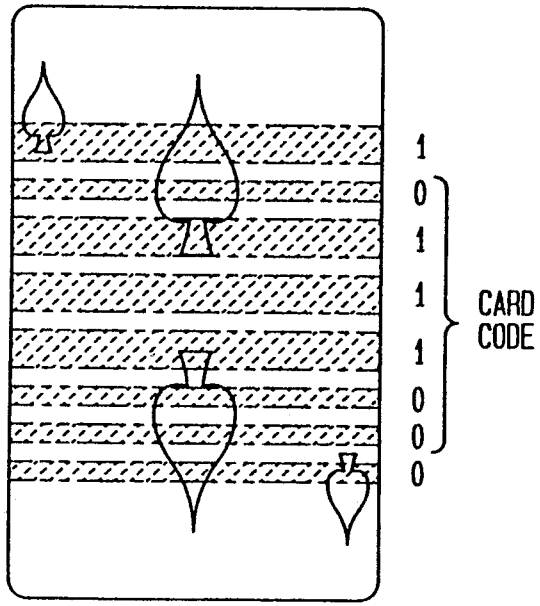
FIG. 6 is a representation of a playing card, specifically the three of diamonds, showing a typical bar coding as phantom shaded portions since they are not visible to the naked eye. The bars traverse the width of the card in a direction at right angles to the longitudinal axis of the card and are over-printed on the face markings of the card, which of course are not affected by the overprinting since the bar codes are invisible to the human eye. The bar codes may also be overprinted in the longitudinal direction instead of the vertical direction as shown. In either case, the bar code will be read as long as the card is passed in a direction transverse (that is, not parallel) to the direction in which the bars are printed, so long as a portion of each bar of the code is read.

As shown in FIG. 6, the playing card, 2 (2 of spades), is marked with a bar code consisting of spaced apart bars some wide and others narrow, which bars extend from one longitudinal margin to the other, the bars running in a vertical direction at right angles to the longitudinal axis of the card. A wide bar, in this illustration, represents the binary digit 1, and a narrow bar represents the binary digit 0. A wide bar is typically from 50% to about 300%, preferably 100% wider than a narrow bar. The width of the spacing between bars is not narrowly critical provided it is at least as wide as a narrow bar. Each wide and narrow bar represents a zone of contrasting reflectivity relative to the background, that is, the spacing between bars. By way of example for this specific illustration, four bits are used to identify the face value of the card, and two bits to identify the suit. A series of 8 bars makes one byte and each card is uniquely identified by a combination of six bits within the series, the other two bits being used to determine the orientation of the card being read, and to detect errors. To read the code in FIG. 6, some portion of each opposed longitudinal edge of the card must pass over the reading means.

The following table represents each value of a card in a deck, in binary form.

| | Card Value | | | | | | | | | | | | |
|---|---|---|---|---|---|---|---|---|---|---|---|---|---|
| Bit | A | 2 | 3 | 4 | 5 | 6 | 7 | 8 | 9 | 10 | J | Q | K |
| 1 | 0 | 1 | 1 | 1 | 1 | 1 | 0 | 0 | 0 | 0 | 0 | 0 | 0 |
| 2 | 0 | 1 | 0 | 0 | 0 | 0 | 1 | 1 | 1 | 1 | 0 | 0 | 0 |
| 3 | 0 | 0 | 1 | 1 | 0 | 0 | 1 | 1 | 0 | 0 | 1 | 1 | 0 |
| 4 | 0 | 0 | 1 | 0 | 1 | 0 | 1 | 0 | 1 | 0 | 1 | 0 | 1 |
| 5 | | | 0 | | | 0 | | | 1 | | 1 | | |
| 6 | | | 1 | | | 0 | | | 1 | | 0 | | |

Figure 7:
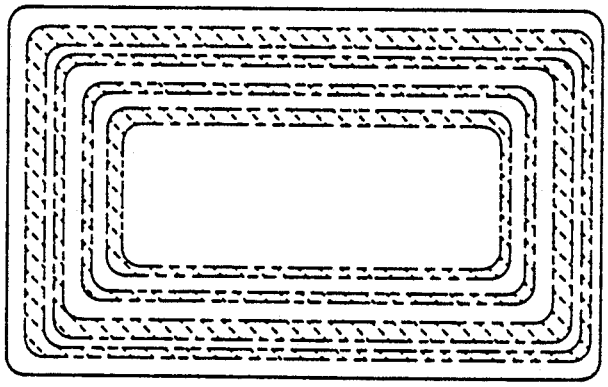
FIG. 7 is a representation of the playing card showing another bar coding as phantom shaded portions along each of the four margins of the card.

FIG. 7 represents a variation for bar-coding a card in which each bar is peripherally continuous on at least two sides of the rectangle, and all the bars are spaced apart from another. Since the code is read by reading 8 bars, a set of bars to be read consists of four bars along two sides of the rectangle, and four bars from the opposed remaining two sides of the rectangle. If bit 1 happens to be the same as bit 8, or bit 2 happens to be the same as bit 7, or bit 3 happens to be the same as bit 6, then the bars corresponding to those bits will have the same width along the entire periphery and appear as continuous. As before, the width of the spacing of the peripheral bars must be at least as wide as the narrow bars.

The card will be read when passed across the reading means in any orientation, requiring only that two opposed edges of the rectangular card traverse the reading means.

Figure 8:
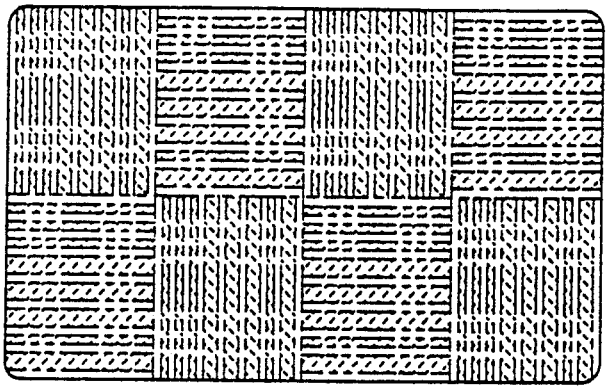
FIG. 8 is a representation of the playing card showing still another bar coding as phantom shaded portions in discrete blocks across the entire face, the code being alternated in longitudinal and vertical directions, so that the card will be read as long as a portion of the card passes over the electro-optical reading means.

Referring now to FIG. 8, there is shown yet another bar coding configuration in which the bar coding of FIG. 6, on a diminished scale several times smaller than that of FIG. 6, is reproduced repetitively a plurality of times in adjacent, parallel relationship in two adjacent rows. Each row has the same set of 8 bars except that each contiguous set is rotated 90° from the other. The card is identified as long as any set of 8 bars in either row is passed over the reading means. Thus the card will be read even if only two adjacent edges of the card traverse the reading means.

The difference in reflectivity read by the reading means determines whether the space read contains a bit. The reading means can only distinguish between reflective and nonreflective portions in the wavelength range visible to the reading means. Thus, since this wavelength range cannot be in the visible because it would mar the appearance of the card, the bar coding is imprinted so that it is invisible to the human eye, but visible to the reading means. The reading means therefore can use any wavelength range which is either in the infra-red or in the ultraviolet, the former being preferred.

It will now be evident that the inks used to print the visible indicia for values of the cards should not be readable by the reading means. For example even black indicia such as the Ace of spades which appears jet black to the human eye and would be expected to absorb in the infrared wavelength, can be printed in an ink which appears to be jet black to the human eye but does not absorb substantially in the infrared region. However an imprint of a bar code is obtained by having bars being dull (that is, absorptive) and the spaces and background being shiny (that is, reflective); or, vice versa.

In another embodiment, the invisible ink in which the bar code is printed can be chosen to fluoresce in the visible or infrared when illuminated by an appropriate UV light source.

In general, a clandestine bar code, namely one which cannot be read by the naked eye, may be overprinted upon any surface which already bears visible indicia, for example, a garment label, a ticket to a ball game, stock certificates, legal documents, bank drafts, checks and bank notes. When such a surface is textured, the overprinted code will be readable by either an infrared or ultraviolet detection system, that is, in a range outside the visible. When the surface is smooth, one has the option of providing either a textured bar code, or a code in invisible ink.

In the particular instance of conveying printed information in a predetermined limited area, for example a printed page of text, the use of invisible inks readable in the infrared or ultraviolet may be used to increase the density of text several fold. For example, a page of conventionally printed text, printed in ink which to the eye appears jet black, may be overprinted with an invisible ink which is readable in the infrared, and again overprinted with an invisible ink which is readable in the ultraviolet. Thus, the number of forms of text is limited only by the optical wavelength band width of the detectors, the band width of the exciting radiation, and the responsivity of the inks, whether absorbers or fluorescers. In some instances, the inks may not be overprinted one on top of the other, but within unprinted or blank spaces such as interlinearly in a page of conventional text.

Description of Operation of the Card Reader

The card dealer is switched on by pressing any key whereupon it powers up and responds by indicating the basic deal set for the particular memory in which is stored a multiplicity of deals. In this embodiment the basic deal is a random deal to emulate a freshly shuffled deck which deal is always different each time the card reader is powered up.

The random deal is prepared by combining the random bytes in the memory on "power up" with a permanently stored "random deal" generated by thoroughly, manually shuffling a deck of cards. The "power up" bytes are summed and then reduced to an 8-digit binary number (the master number) by discarding the overflows. This master number is combined with the first number in the random deal to select the first card to be dealt to North. The digits in the master number are then "rotated" to form a new number which selects a second card from the random deal to assign to North. The process repeats until all the cards are assigned in order. Since only six digits of the 8-digit master number are needed for this process the first two digits are used to eliminate redundancies; that is, if a card is selected by this process which card has already been assigned, the first two digits are used to select an alternate card which may be either one card up, or one card down.

The sole function of this basic random deal is to indicate everything is operational; however, this basic random deal is more nearly random than any ordinary manual shuffle will produce, and may be dealt if desired.

Up to 999 deals may be stored in the memory of this device. A cartridge would provide as large a memory as desired. Each deal stored is identified by a number. The basic deal upon powering up is changed to another preselected deal by actuating keys 17, 18 and 19 which correspond to the unit, tens and hundreds digits respectively, each stepwise actuation incrementing that digit by one. When the number 9 is reached the subsequent actuation rolls the digit back to 0. The number arrived at is read by key 16. The chosen number of the deal is used to index the deal into the random access memory (RAM).

When a card is passed over the reading means, the code is read and compared to the code stored in the RAM which specifies the location to which the card is to be dealt. This specification of the location is transmitted to the indicating means which then provides either a visual or an audible signal to the dealer, instructing him to deal the card to the location indicated, example "West". This process of reading cards is repeated seriatim until the deck is dealt.

Should the dealer make an error and give a card to the wrong player, that is, one to whom the card was not directed by the device, the card may be re-read at any time during the deal, or after, provided the device has not been advanced to a new hand. Thus, for example, where an audible signal is given, and not heard distinctly, or is questioned by a player, the location of the card can be re-established by simply re-reading the card.

Should the device fail to read an appropriate bar code the device announces ERROR so that the card can be slid over the reading means again. Repeated ERROR signals for a particular card indicates that the bar code itself is damaged.

Upon the deck being dealt, and no further cards having been read for a predetermined period of time, say 1 minute, the card reader powers down automatically thereby conserving battery power.

Figure 3:
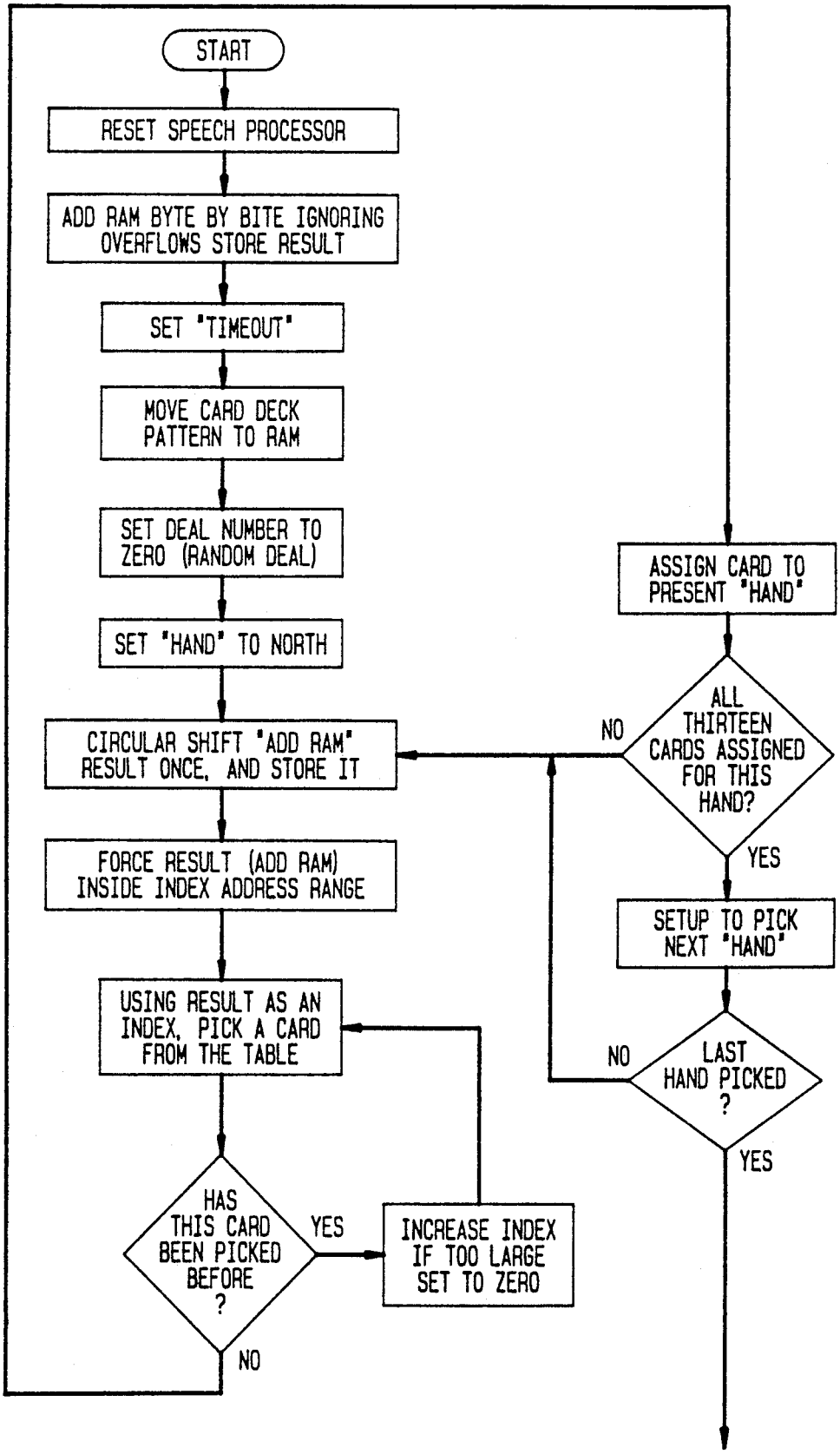
FIGS. 3–5 are functional flowchart representations of a preferred method of operation of the microprocessor.

Referring to FIG. 3, the initializing of the device is initiated at "start" and is completed before it stacks a random deck. The random deck is stacked at the end of the flowsheet in FIG. 3.

Figure 4:
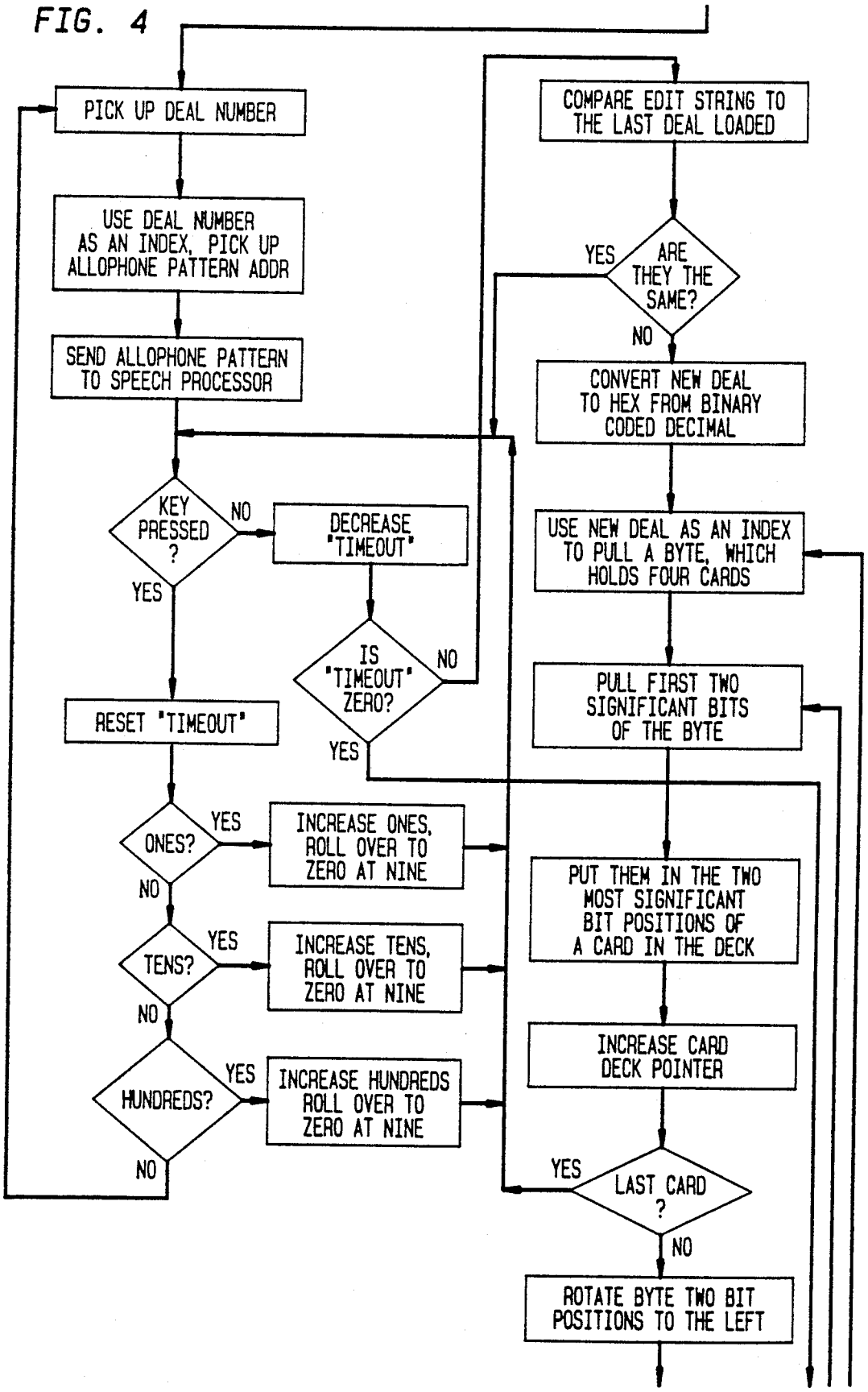

Referring now to FIG. 4, it shows the deal number for a random deck which number can be any predetermined number, for example, 000. The keys are then read and the next action is a function of the particular keys pressed. When or if the deal is changed, it loads a new deal into the random access memory. If no key is pressed within a preselected period of time, the unit powers down as shown in FIG. 5.

Figure 5:
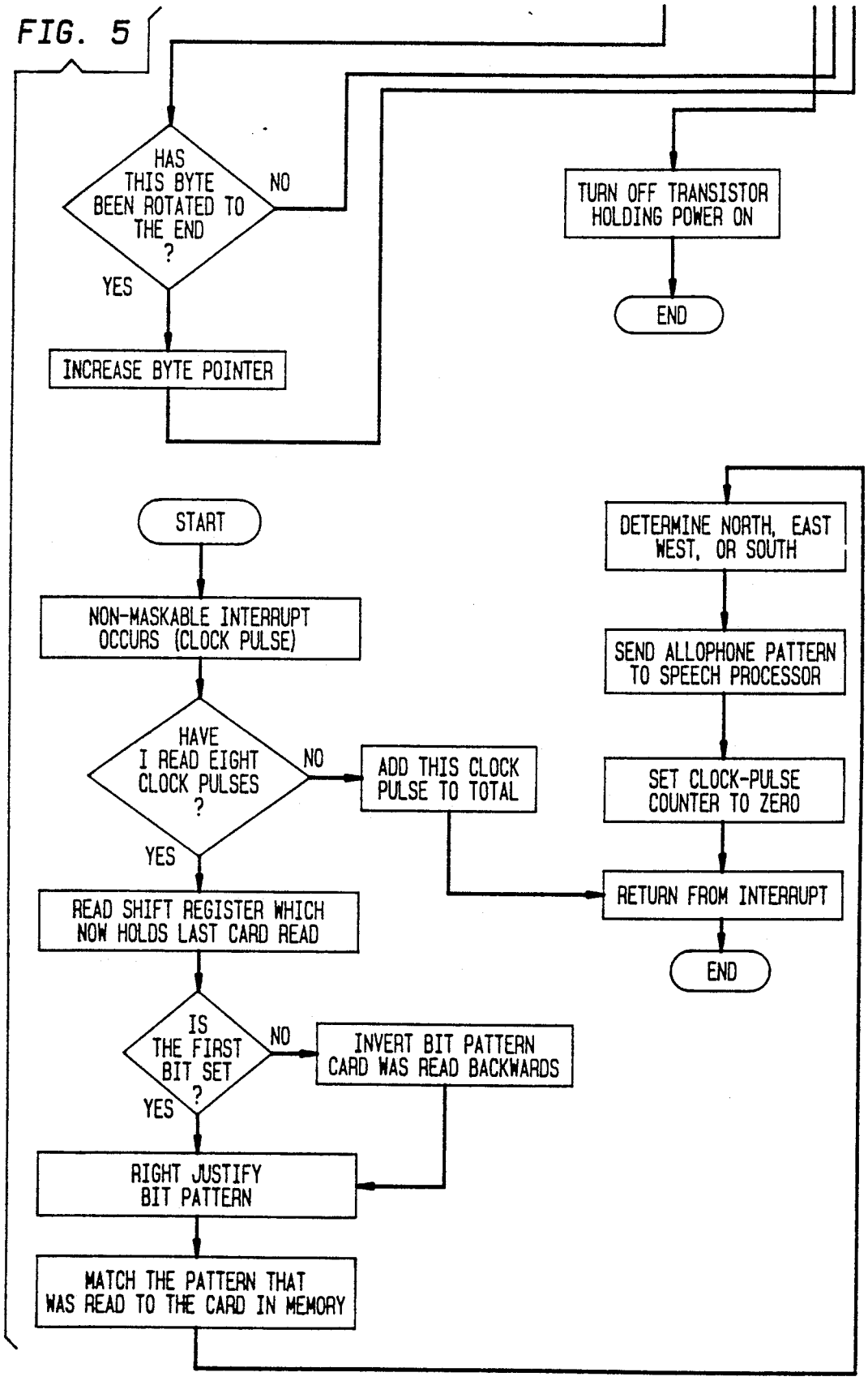

Referring further to FIG. 5, the cards are read on an interrupt basis. If a bit is detected, the normal program flow is interrupted until all 8-clock pulses are read. The card is checked to determine whether it was read from front to back or vice versa. All appropriate bar codes begin with 1 and end with 0. If the code read begins with 0 and ends with 1, it has been read backwards. If read backwards, the bit pattern is internally rotated by the software so that the leading bit is the end bit, the rotated bit pattern being an inverted mirror image. The pattern read is then matched to the pattern of the deal loaded into random access memory, as referred to in FIG. 4 under the heading "Change Deal". From the comparison, North, East, West or South are indicated. This indication is either relayed audibly or visually with appropriate display of a light at the designated position. The program then returns to the point at which it was interrupted, and repeats the process.

Thus, should one desire to change the deal entered with the keys, and then enter a different deal, one can simply collect the cards already dealt and activate the new deal, then proceed to read the cards. The device is always ready to read a card, and it is not necessary to set it in the "read" mode.

We claim:

1. An apparatus for manually dealing coded playing cards to each of plural locations so that a preselected set of cards will be dealt to each specific location, without contacting the sides of the cards, the apparatus comprising, a housing having a platform with a surface over which a plurality of coded cards are passed face down and read, one card at a time;

reading means for electro-optically reading each said one card as it is moved past the reading means without using a guide means to orient the card;

means for storing the number of predetermined "hands" or sets which are to be dealt as chosen;

code-processing means for processing the code read from each card in a predetermined manner to execute a program which identifies each location to which each card is to be dealt; and, indicating means to indicate the location to which said each card read, is to be dealt.

2. The apparatus of claim 1 wherein said electro-optical reading means is sensitive to actinic radiation in the wavelength range above about 7000 Angstroms (700 nm) but below about $2.2\times10^5$ Angstroms.

3. The apparatus of claim 2 wherein said area of said deck is comparably similar in area to that of said playing card, said reading means is a light source and matching detector mounted within said housing and directed upwardly through a portion of said surface, said portion being permeable to the wavelength to which said detector and source are sensitive; and said apparatus is portable.

4. The apparatus of claim 3 wherein said code-processing means permits a dealer to verify the location to which a card is designated, at any time during or after the deal.

5. The apparatus of claim 4 wherein said code-processing means is a solid-state device with no moving parts, hence essentially free of risk of failure due to mechanical malfunctions.

6. The apparatus of claim 5 wherein said actinic radiation is in the infrared wavelength, said reading means comprises an infrared light source and matching detector.

7. The apparatus of claim 5 wherein said actinic radiation is in the ultraviolet wavelength, said reading means comprises an ultraviolet light source and matching detector selected from a visible light detector and an ultraviolet light detector.

8. The apparatus of claim 5 wherein said actinic radiation is in the visible wavelength, said reading means comprises a visible light source and matching infrared detector.

9. A method for manually sorting while dealing a set of coded cards having an essentially invisible bar code printed on the face of each card without contacting the sides of the cards, comprising, manually sliding said cards, one at a time, face downwards, over the upper surface of a card reading means;

reading each card electro-optically as it is moved past the reading means without using a guide means to orient the card;

storing a number of predetermined "hands" or sets which are to be dealt as chosen;

processing the code read from each card in a predetermined manner to execute a program which identifies each location to which each card is to be dealt;

electronically indicating the location to which said each card read, is to be dealt; and, manually dealing each of the coded playing cards to each of plural locations indicated, so that a preselected set of cards will be dealt to each specific location.

* * * * *